US008167150B2

(12) United States Patent
Chu

(10) Patent No.: US 8,167,150 B2
(45) Date of Patent: May 1, 2012

(54) DRAWER PARTITION KIT

(76) Inventor: Hsueh-Kan Chu, Taipei (TW)

( * ) Notice: Subject to any disclaimer, the term of this patent is extended or adjusted under 35 U.S.C. 154(b) by 449 days.

(21) Appl. No.: 12/349,022

(22) Filed: Jan. 6, 2009

(65) Prior Publication Data

US 2010/0170864 A1 Jul. 8, 2010

(30) Foreign Application Priority Data

Jan. 7, 2008 (TW) ..... 97200369 U

(51) Int. Cl.
*A47F 5/00* (2006.01)

(52) U.S. Cl. ..... 211/184

(58) Field of Classification Search ..... 211/184, 211/43, 11; 108/60, 61; 220/500; 206/529, 206/534, 561

See application file for complete search history.

(56) References Cited

U.S. PATENT DOCUMENTS 2,747,959 A * 5/1956 Ingelson ..... 312/140.3
3,484,226 A * 12/1969 Golightly ..... 65/291
3,501,020 A * 3/1970 Krikorian ..... 211/184
4,595,246 A * 6/1986 Bross ..... 312/348.3
4,917,429 A * 4/1990 Giger ..... 296/37.6
5,664,856 A * 9/1997 Pacetti ..... 312/348.3
5,775,523 A * 7/1998 Teringo ..... 211/184
6,044,989 A * 4/2000 Sosso ..... 211/189
6,290,077 B2 * 9/2001 Sosso ..... 211/189
6,460,710 B1 * 10/2002 Dardashti ..... 211/184
6,805,250 B2 * 10/2004 Ondrasik ..... 211/184
6,886,700 B2 * 5/2005 Nagel ..... 211/59.3
6,913,156 B1 * 7/2005 Wolff ..... 211/184
6,991,307 B2 * 1/2006 Hoenig ..... 312/348.3
7,114,300 B1 * 10/2006 Culp ..... 52/211
2001/0035385 A1 * 11/2001 Sosso ..... 211/184
2003/0034319 A1 * 2/2003 Meherin et al. ..... 211/184
2004/0173546 A1 * 9/2004 Nagel ..... 211/59.3
2010/0170864 A1 * 7/2010 Chu ..... 211/184

* cited by examiner

*Primary Examiner* — Sarah Purol

(57) ABSTRACT

A drawer partition kit is described. The drawer partition kit comprises at least one partition board and a partition rack. The partition rack, applied in a drawer having a space, has a U-shaped space for storing things. The U-shape space has a size. The partition rack has slots under the U-shaped space for positioning the partition board and for reducing the size of the U-shaped space. The partition board has a first side plate for being positioned and has a vertical plate capable of being moved to change the space of the drawer. A plurality of such partition racks may be connected with each other. The materials of the partition rack may alternatively be metals or other materials having excellent weather-resistance and supporting forces.

5 Claims, 4 Drawing Sheets

DRAWER PARTITION KIT

BACKGROUND OF THE INVENTION

1. Field of the Invention

This invention relates generally to a kit for providing operation space to be divided and to store things, and more particular, to a drawer partition kit having at least one partition board and a partition rack, which relates to basis of applied and material mechanics.

2. Description of the Related Art

A function of a sold partition tool was usually limited to division of the interior space of a drawer by which some squares were formed for storing things. Another related tool was a square plate which also merely provided some squares for storing things. Those tools were made in considerations of only location, sizes and shapes of stored things. The sold tools were provided without considerations of factors such as combination and personal customs, and lacked of space utility, suitability and flexibility.

SUMMARY OF THE INVENTION

To have space utility, suitability and flexibility, adjusting a partition tool to have more functions and convenience may be proper way to research and develop.

A drawer partition kit is provided. A partition rack is applied in a drawer having a space. The partition rack has a U-shaped space for storing things. The U-shape space has a size. The partition rack has a plurality of slots under the U-shaped space for positioning the partition board and for reducing the size of the U-shaped space. The partition board has a side plate for being positioned and has a vertical plate capable of being moved to change the space of the drawer.

DETAILED DESCRIPTION

Figure 1:
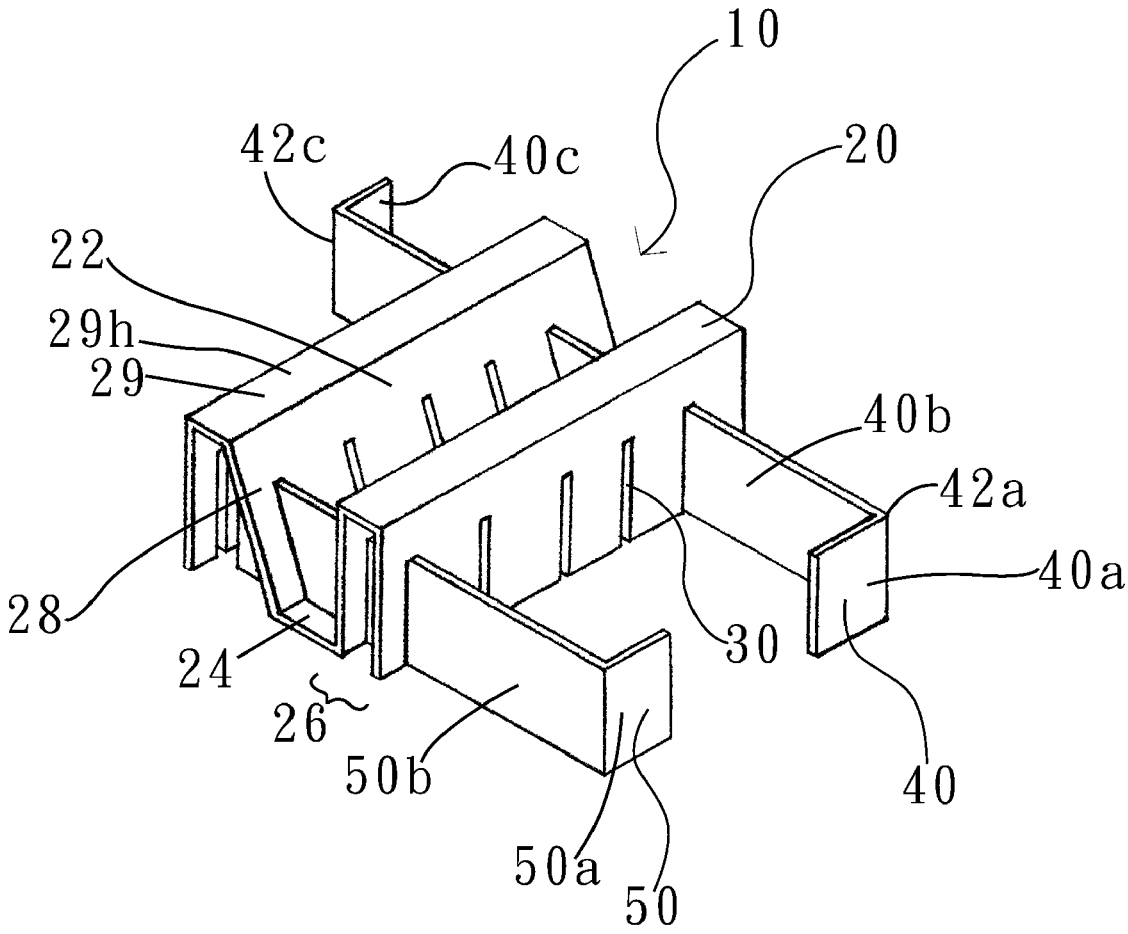
FIG. 1 schematically shows a drawer partition kit is longitudinally located in a center position.

Referring to FIG. 1, a drawer partition kit 10 comprises a partition rack 20 applied in a drawer having a space. The partition rack 20 has a U-shaped space 22 for storing things. The U-shape space 22 has a size. The partition rack 20 has a plurality of slots 30 under the U-shaped space 22 for positioning the partition board 40 or 50 and for reducing the size of the U-shaped space 22. The partition board 40 or 50 has a side plate 40*a*, 40*c* or 50*a* for being positioned and has a vertical plate 40*b* or 50*b* capable of being moved to change the space of the drawer.

The drawer partition kit 10 comprises at least one partition rack 20 and at least one partition board 40 or 50 for the drawer. The partition rack 20 and the partition board 40 or 50 may not be functioned separately. The partition rack 20 and the partition board 40 or 50 cooperate to be capable of being positioned in a drawer, and to obtain separate spaces. At least one preserved thing may be put in those separate spaces. The partition board 40 or 50 divides a whole space of the drawer into a plurality of cells. The cells respectively have sunk partitions for storing small-scale things. The partition rack 20 and the partition board 40 or 50 may collectively serve as the drawer partition kit. The concept of the invention may be developed by combining the partition rack 20 and partition board 40 or 50. The concept may alternatively be developed by a method of using the drawer partition kit 10 having a step of applying a partition rack 20 in a drawer or a step of applying a partition board 40 or 50 in a drawer.

Figure 2:
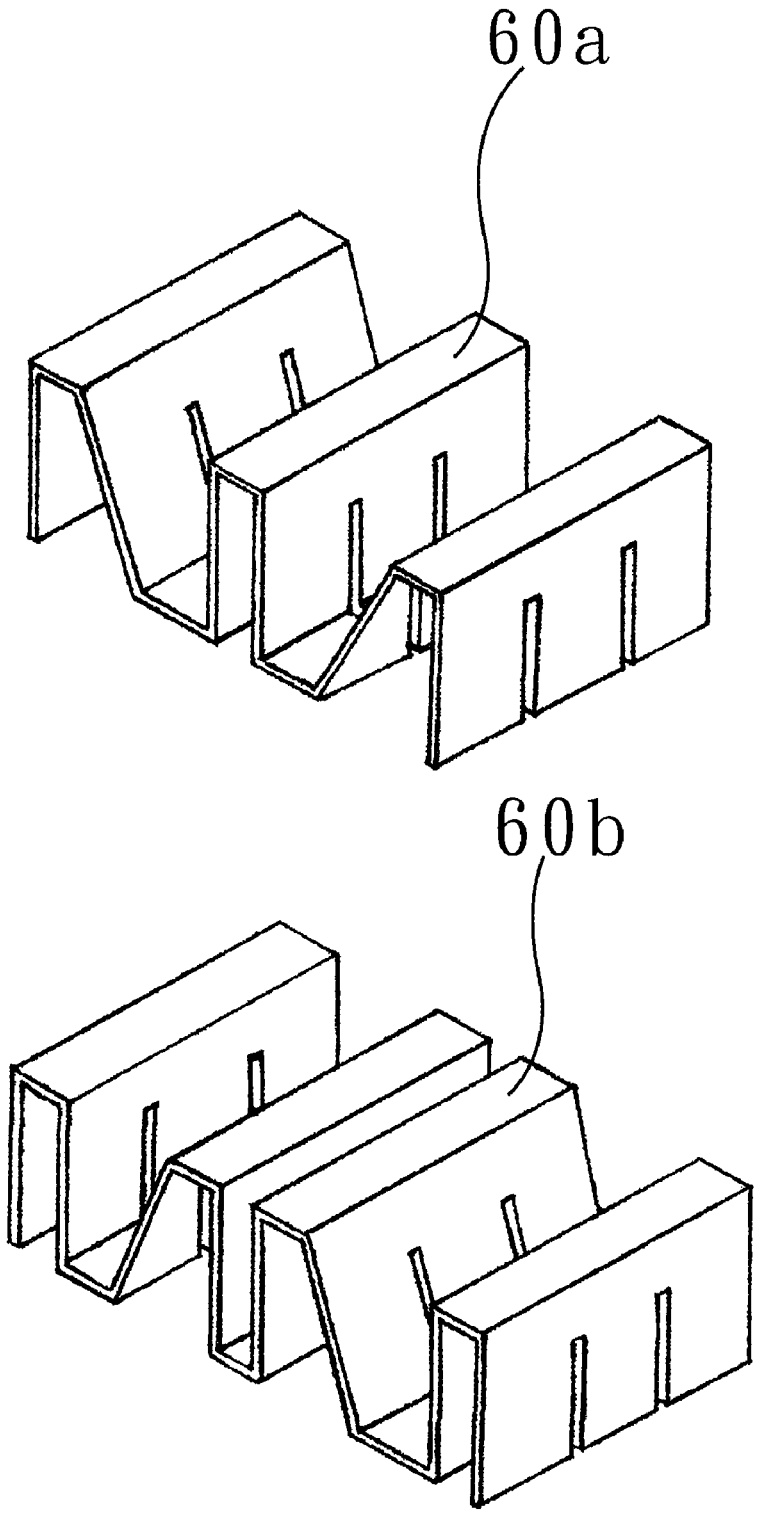
FIG. 2 schematically shows that partition racks are continuously linked counter in a band way on a single side (right or left)

In the drawer partition kit 10, the partition rack 20 may be characteristically integrated. A center 24 of the partition rack 20 may be a first horizontal panel 24. A first side portion 26 of the partition rack 20 is vertically connected with the first horizontal panel 24. The first side portion 26 is first folded with an angel of about 90 degrees, and is then second folded down with an angel of about 90 degrees. A second side portion 29 of the partition rack 20 is connected with a sloped panel 28. The sloped panel 28 is connected with a second horizontal panel 29*h*. The second horizontal panel 29*h* is folded down with an angle of about 90 degrees. The second side portion 29, the first side portion 26 and the center 24 of the partition rack 20 are integrated to serve as a shelf. In a lower portion of the shelf 20, the partition rack 20 has the spaced slots 30 formed and vertical to the horizontal panel 29*h*. The partition board 40 may comprise at least one first thick plate 40*b*. The first thick plate 40*b*, horizontally through one of the slots 30 the partition rack 20, has two sides 42*a* and 42*c* respectively protrude along and out of the first side and the second side of the partition rack 20. Each of the slots 30 is formed by about four panels collectively having a U shape. The slots 30 may be sloped and may be sloped with an angle. The angle may be arbitrarily changed. The first thick plate 40*b* is cooperated with one of the slots 30, to laterally or vertically slide, thereby adjusting and fixing an operation position of a tenon. In the drawer partition kit 10, the partition rack 20 is characterized by, for example, that a top portion of the partition rack 20 has at least one recess 22 for being put things. The four-panels-formed slots 30 may be sloped and may be arbitrarily sloped with an angle, wherein the angle may be arbitrarily changed. The four-panels-formed slots 30 may be alternatively three-panels-formed slots, two-panels-formed slots or one-panel-formed slots. To have more applications, a bottom of the shelf may be reversed to be a top of the partition rack 20. The drawer partition kit 10 may be wholly or partially applied to other applicable use. This application and the alternatives reduce the volume of the drawer partition kit 10. The partition rack 20 and the partition board 40 or 50 may be arbitrarily moved. A space for operation formed by the partition rack 20 and the partition board 40 or 50 may be flexibly increased or adjusted. The moving step, the increasing step and the adjusting step are performed according to the sizes of the things in the space. In another drawer partition kit, referring to FIG. 2, a plurality of partition racks 60*a* or 60*b* may be arranged side by side. Alternatively, on a right side and a left side, or on a single side of the drawer partition kit, the partition racks 60*a* or 60*b* are individually arranged by being continuously linked counter in a band way, so that the drawer partition kit may have more uses. When the partition racks 60*a* or 60*b* are in a drawer, the partition racks 60*a* or 60*b* having the four-panels-formed slots 30 (FIG. 1) wholly have a width and a bottom. The friction, between the drawer and the bottom or the width of the partition racks 60*a* or 60*b*, is a help to fix the partition racks 60*a* or 60*b* and a help to fill an interior space of the drawer with the partition racks 60*a* or 60*b*. Accordingly, the storing types of the drawer have more changes. The utility of the interior space of the drawer is therefore increases. It serves as a continuous model of the partition racks 60*a* or 60*b* in a drawer partition kit.

Figure 4:
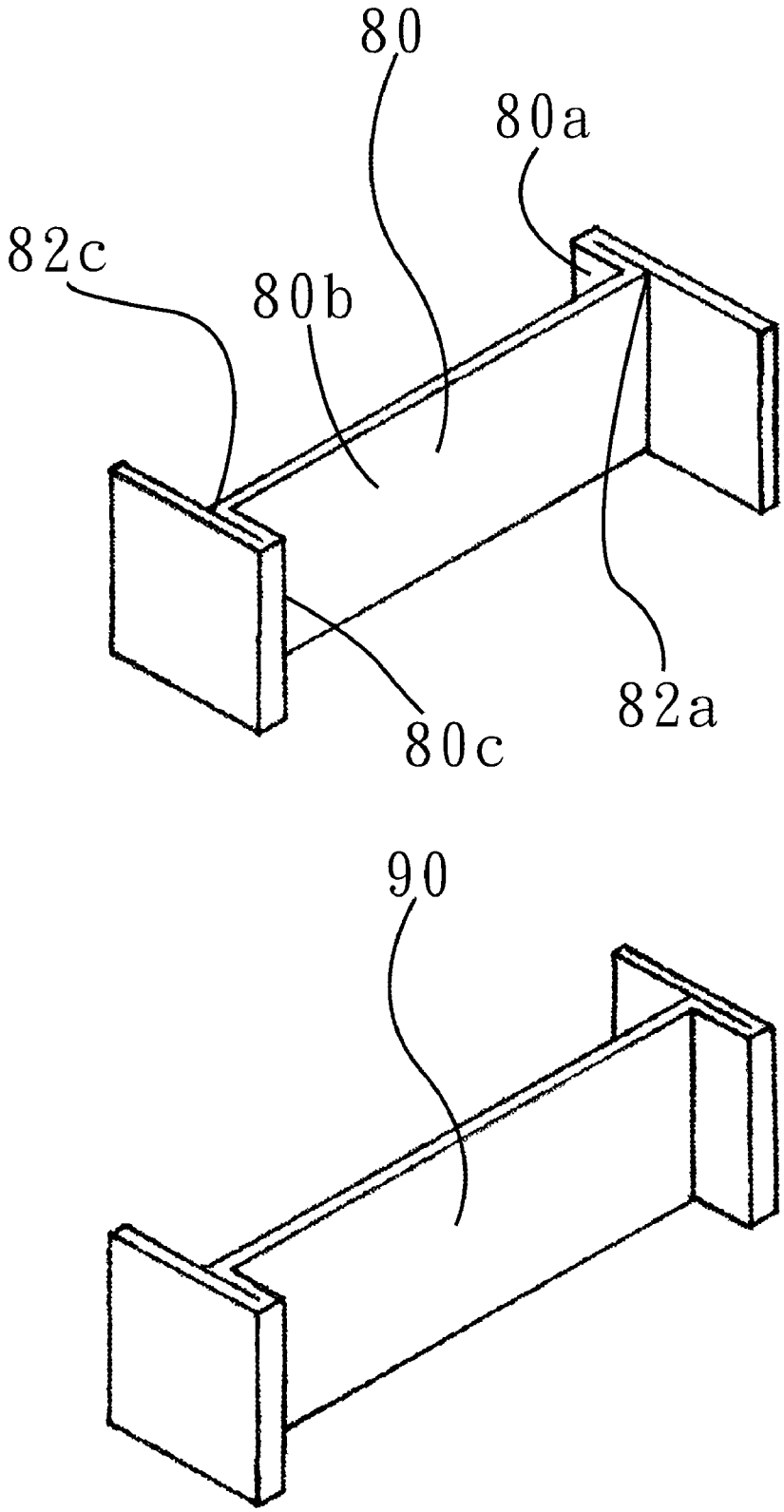
FIG. 4 schematically shows a third type and a fourth type of partition board.

In a drawer partition kit 10 (FIG. 1), the partition rack 20 may be cooperated with four types of partition boards. A first type of a partition board is integrated. A center 40*b* of the first type of the partition board 40 is a vertical plate 40*b* having a first side 42*a* and a second side 42*c*. The partition board 40 has a first side plate 40*a* is linked with the vertical plate 40*b* through the first side 42*a* at an angle of about 90 degrees. The partition board 40 has a second side plate 40*c* is linked with the vertical plate 40*b* through the second side 42*c* at an angle of about 90 degrees. The first side plate 40*a* and the second side plate 40*c* are respectively extended to the left and right of the vertical plate 40*b*. The extensions 40*a* and 40*c* are made to prevent the partition board 40 from side tilting. A second type of a partition board 40 is characterized to be integrated. A center 40*b* of the second type of the partition board 40 is a vertical plate 40*b* having a first side 42*a* and a second side 42*c*. The partition board 40 has a first side plate 40*a* linked with the vertical plate 40*b* through the first side 42*a* at an angle of about 90 degrees. The partition board 40 has a second side plate 40*c* linked with the vertical plate 40*b* through the second side 42*c* at an angle of about 90 degrees. The second side plate 40*c* linked with the vertical plate 40*b* in a first direction. The first side plate 40*a* is linked with the vertical plate 40*b* in a second direction the same as the first direction. The links are made to prevent the partition board 40 from side tilting. A third type of a partition board 80 (FIG. 4) and a fourth type of a partition board 90 respectively have characteristics similar with the first type of the partition board and the second type of the partition board. The difference is that the linked first side plate 80*a* is folded along a third direction opposite to the first direction, to prevent the partition board 80 from side tilting. The linked second side plate 80*c* is folded along the first direction (third type) or the third direction (fourth type), to prevent the partition board 80 from side tilting. The partition rack 20 (FIG. 1) has two sides. The two sides have widths also to prevent the partition rack 20 from side tilting. The partition rack 20 has a plate thickness. The friction between the plate thickness and the drawer causes resistance to prevent the partition rack 20 from sliding. The non-sliding partition rack 20 may be independently applied in the drawer. By the plate thickness of the partition rack 20, a pitch for dividing a space is increased to prevent the partition rack 20 from hitting. A space, formed of the partition rack 20 of the drawer partition kit, serves as a storing space for storing things a little bigger. In a direction vertical with the partition rack 20 of the drawer partition kit 10, and in a horizontal direction in which the plates are extended in an angel of about 90 degrees. By penetrating or fixing the partition board 40 through one of the four-panels-formed slots 30 of the partition rack 20, or by partially penetrating or fixing the partition board 50 (FIG. 1) through a three-panels-formed slot of the partition rack, a collective structure of sliding adjustment and tenon fixing is formed. To be a cross application, the partition rack 20 is applied to partially penetrate or fix through a slot 30, and the partition rack 20 is applied in a way of longitudinal and lateral crossings. Both of the partition rack 20 and the partition board 40 or 50 can be independently arranged. Alternatively, a plurality of the partition racks 60*a* or 60*b* (FIG. 2) or partition boards 40, 50, 80 or 90 may be arranged side by side, or may be arranged to fill an interior space of the drawer. By the arrangements, the utility of the interior space of the drawer has more application flexibility. The partition rack or the partition board 40, 50, 80 or 90 may be arbitrarily moved or added more. The movement or addition provides a great diversity changes and full functions.

Those kinds of storage are full of interests and just like doing puzzles. The whole space arrangement in the drawer may achieve a perfect combination type. The arrangement is a part of the technique content of the drawer partition kit 10 (FIG. 1).

A first embodiment is provided. First, referring to FIG. 1, a partition rack 20 may be vertically located in a center position of a drawer, to divide a space of the drawer into two block spaces. The partition rack 20 is provided for locating the attachment of the stored things. The attachment is, for example, a lid of small pan, a lid of a microwave oven, a turning shovel and so on. With such a partition rack 20, the utility and arrangement of the space is easy to achieve.

A second embodiment is provided. Referring to FIG. 1 again, the partition rack 20 of the drawer partition kit 10 is located in both left and right sides of the drawer to leave center area of the drawer, or located in one side of the space to leave another side of the space, for storing fluffy things. On the partition rack 20, a sample-position mark, small thing or can or bottled article is vertically or horizontally located. This location increases the utility of the interior space of the drawer.

A third embodiment is provided. Referring to FIG. 1 again, in a drawer partition kit 10, a partition rack 20 is horizontally positioned, and is closely contacted with a front board of a drawer. Such a partition rack 20 does not divide the space in a drawer. The space is suitable for storing one thing need to be often accessed, or one thing which length is greater than the longitudinal length of the drawer. The partition rack 20 may also serve as an area for locating a sample, thereby increasing the utility of the interior space of the drawer.

A fourth embodiment is provided. Referring to FIG. 1 again, in a drawer partition kit 10, a partition rack 20 is horizontally positioned, and closely is contacted with a back board of a drawer. Such a partition rack 20 does not divide the space in a drawer. The space is suitable for storing one thing need to be often accessed, or one thing which length is greater than the longitudinal length of the drawer. The partition rack 20 may also serve as an area for locating a sample. The space is arranged and partitioned to storage things as more as possible.

A fifth embodiment is provided. Referring to FIG. 1 again, in a drawer partition kit 10, a plurality of partition racks 20 may be continuously arranged side by side. Alternatively, on a single side of a drawer partition kit, or on a right side and a left side of a drawer partition kit, partition racks 60*a* or 60*b* (FIG. 2) are continuously linked counter in a band way, to fill an interior space of the drawer, for providing more kinds of storing types.

A sixth embodiment is provided. Referring to FIG. 1 again, in a drawer partition kit 10, a partition rack 20 is provided. The partition rack 20 has four-panels-formed slots 30 may be sloped and may be arbitrarily sloped with an angle, wherein the angle may be arbitrarily changed. To have more applications, a bottom of the partition rack 20 may be reversed to be a top of the partition rack 20.

A seventh embodiment is provided. Referring to FIG. 1 again, and referring to FIG. 4, each of the partition boards 40, 50, 80, 90 may be vertically and arbitrarily located and cooperated with a partition rack 20. The partition rack 20, in a center position of a drawer, is closely contacted with a back board or front board. Consequently, a space of the drawer may be divided into a plurality of left and right block spaces. The block spaces are formed for storing small-scaled things. This formation is a first type of a combination for combining the drawer partition kits.

An eighth embodiment is provided. Referring to FIG. 1 again, and referring to FIG. 4, in a drawer partition kit 10, each of the partition boards 40, 50, 80 and 90 may be horizontally cooperated with a partition rack 20, and may be located in a center position of a drawer. When a size of a left space or a right space needs to be adjusted, each of the partition boards 40, 50, 80 and 90 of a drawer partition kit 10 may serve as a slideway. One of the partition boards 40, 50, 80 and 90 may be moved to the left or right, and is then located. The adjustment of the size of the left or right space is then completed, to obtain a second type of a combination for combining the drawer partition kit 10.

A ninth embodiment is provided. Referring to FIG. 1 again, and referring to FIG. 4, in a drawer partition kit 10, one of the partition boards 40, 50, 80 and 90 may be longitudinally or laterally cooperated with a partition rack 20 and longitudinally or laterally located in any position. The lengths of the partition rack 20 and a partition board may be changed. The partition rack 20 and one of the partition boards 40, 50, 80 and 90 may be arbitrarily combined, crossed or fixed. The partition rack 20 and one of the partition boards 40, 50, 80 and 90 may be partially penetrated or partially fixed with each other. The one of the partition boards 40, 50, 80 and 90 may be cooperated with at least one four-panels-formed slot 30 of the drawer partition kit 10, by a way of longitudinal and lateral crossings. A third type of a combination for combining the drawer partition kits is obtained.

A tenth embodiment is provided. Referring to FIG. 1 again, and referring to FIG. 4, in a drawer partition kit, a partition rack 20 and one of the partition boards 40, 50, 80 and 90 are independently and arranged, respectively. Alternatively, they are independently arranged side by side or arranged to fill in a space of a drawer. An operation of an interior space in a traditional draw is followed.

Figure 3:
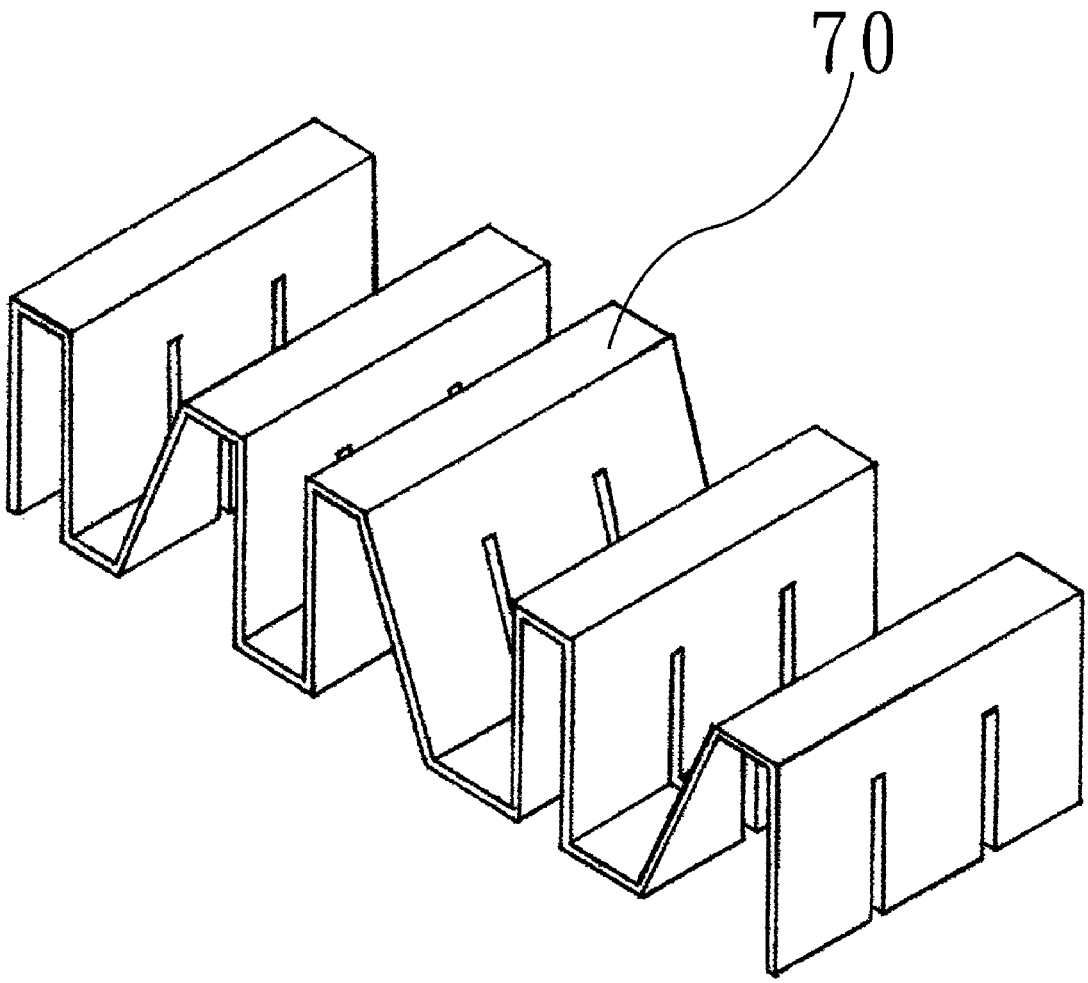
FIG. 3 schematically shows that partition racks are continuously linked counter in a band way on both sides.

An eleventh embodiment is provided. Referring to FIG. 1 and FIG. 3, in a drawer partition kit 10, a plurality of such partition racks 70 may be connected with each other. Four-panels-formed slots of the partition racks may be omitted. The materials of the partition rack 70 may alternatively be metals or other materials having excellent weather-resistance and supporting forces. Those materials, such as cover materials for roofs, or bottom materials for floor support. Accordingly, the drawer partition kit may have other uses.

Obviously, many modifications and variations are possible in light of the above teachings. It is therefore to be understood that within the scope of the appended claims the present invention can be practiced otherwise than as specifically described herein. Although specific embodiments have been illustrated and described herein, it is obvious to those skilled in the art that many modifications of the present invention may be made without departing from what is intended to be limited solely by the appended claims.

What is claimed is:

1. A drawer partition kit, comprising:

a partition board;

a partition rack having a first horizontal panel, a first side portion and a plurality of slots, wherein the slots are for positioning the partition board in a drawer, and wherein the first side portion is vertically connected with the first horizontal panel;

a second horizontal panel, wherein the slots are vertical to the second horizontal panel; and a sloped panel connected with the second horizontal panel, wherein the partition board has a center, the center is a vertical plate having a first side and a second side, and wherein the partition board has a second side plate linked with the vertical plate through the second side at an angle of about 90 degrees, and wherein the first side plate of the partition board is linked with the vertical plate through the first side at an angle of about 90 degrees.

2. The drawer partition kit of claim 1, wherein the first side plate is linked with the vertical plate in a first direction, and wherein the second side plate is linked with the vertical plate in a second direction the same as the first direction.

3. A drawer partition kit, comprising:

a partition board;

a partition rack having a first horizontal panel, a first side portion and a plurality of slots, wherein the slots are for positioning the partition board in a drawer, and wherein the first side portion is vertically connected with the first horizontal panel;

a second horizontal panel, wherein the slots are vertical to the second horizontal panel; and a sloped panel connected with the second horizontal panel, where the partition board has a center, and wherein the center is a vertical plate having a first side and a second side, and wherein the partition board has a first side plate linked with the vertical plate in a first direction through the first side at an angle of about 90 degrees, and where the linked first side plate is folded along a second direction opposite to the first direction, and wherein the partition board has a second side plate linked with the vertical plate in the second direction through the second side at an angle of about 90 degrees, and wherein the linked second side plate is folded along the first direction.

4. A drawer partition kit, comprising:

a partition board;

a partition rack having a first horizontal panel, a first side portion and a plurality of slots, wherein the slots are for positioning the partition board in a drawer, and wherein the first side portion is vertically connected with the first horizontal panel;

a second horizontal panel, wherein the slots are vertical to the second horizontal panel; and a sloped panel connected with the second horizontal panel, wherein the partition board has a center, and wherein the center is a vertical plate having a first side and a second side, and wherein the partition board has a first side plate linked with the vertical plate in a first direction through the first side at an angle of about 90 degrees, and wherein the linked first side plate is folded along a second direction opposite to the first direction, and wherein the partition board has a second side plate linked with the vertical plate in the first direction through the second side at an angle of about 90 degrees, and wherein the linked second side plate is folded along the second direction.

5. The drawer partition kit of claim 1, wherein the partition rack has a center, a first side portion and a second side portion, and wherein the center is a first horizontal panel, and wherein the first side portion is vertically connected with the first horizontal panel, and wherein the first side portion is first folded with an angel of about 90 degrees, and is then second folded down with an angel of about 90 degrees, and wherein the partition rack has spaced slots vertical to the first horizontal panel.

* * * * *